US005913960A

United States Patent [19]

Fletcher-Jones

[11] Patent Number: 5,913,960

[45] **Date of Patent: *Jun. 22, 1999**

[54] PISTONS

[75] Inventor: David Francis Fletcher-Jones, Burley, United Kingdom

[73] Assignee: Wellworthy Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/463,361

[22] Filed: Jun. 5, 1995

Related U.S. Application Data

[63] Continuation of application No. 08/245,291, May 9, 1994, abandoned, which is a continuation of application No. 08/052,846, Apr. 28, 1993, abandoned, which is a continuation of application No. 07/307,746, Feb. 6, 1989, abandoned.

[30] Foreign Application Priority Data

Feb. 26, 1988 [GB] United Kingdom ..... 8804533

[51] Int. Cl.[6] ..... F02F 3/16; F02F 3/28

[52] U.S. Cl. ..... 92/219; 92/258; 29/888.042; 29/888.044; 123/193.4

[58] Field of Search ..... 29/888.042, 888.044, 29/888.045, 888.047; 92/160, 216, 219, 220, 255, 258, 238; 123/41.35, 193.1, 193.4, 193.6

[56] References Cited

U.S. PATENT DOCUMENTS

| | | | |
|---|---|---|---|
| 1,547,737 | 7/1925 | Daiber | 92/220 |
| 3,424,138 | 1/1969 | Dreisin | 92/216 |
| 4,083,292 | 4/1978 | Goloff | 92/220 X |
| 4,617,887 | 10/1986 | Nagase et al. | 123/193.6 X |
| 4,662,319 | 5/1987 | Ayoul | 123/193.6 X |

FOREIGN PATENT DOCUMENTS

| | | | |
|---|---|---|---|
| 108936 | 5/1988 | Japan | 29/888.044 |
| 31955 | 2/1934 | Netherlands | 29/888.042 |
| 160790 | 12/1921 | United Kingdom | 29/888.042 |

OTHER PUBLICATIONS

Elsbett et al "The Ferrum Piston For Diesel Engines—A Two Piece Articulated Piston Design" SAE 850505, 1985.

*Primary Examiner*—Peter Vo

*Attorney, Agent, or Firm*—Nixon & Vanderhye P.C.

[57] ABSTRACT

A method is described of making a piston crown, the method comprises the steps of making a lower crown portion, the lower crown portion also having piston pin bosses, making an upper crown portion which co-operates with the lower crown portion and joining the lower and upper crown portions together to form an oil retaining chamber. The upper and lower crown portions may be made by a precision casting technique in a ferrous alloy and may be joined by a brazing operation. The piston crown may be part of an articulated piston or may further include integral skirt portions.

8 Claims, 4 Drawing Sheets

PISTONS

This is a continuation of application Ser. No. 08/245,291 filed May 9, 1994 now abandoned, which is a continuation of Ser. No. 08/052,846 filed Apr. 28, 1993, now abandoned, which is a continuation of Ser. No. 07/307,746 filed Feb. 6, 1989, now abandoned.

The present invention relates to pistons, particularly though not exclusively to pistons for internal combustion engines.

It is known to form at least the crown portion of pistons for internal combustion engines from thin walled, ferrous precision castings. It is generally necessary to cool ferrous piston crowns with, for example, oil. This has lead to various complex constructions aimed at retaining oil for cooling purposes.

Due to the need to reduce casting complexity some single piece ferrous crown portions have wall sections which are thicker and consequently heavier than is desirable.

It is an object of the present invention to provide a ferrous piston crown which is easily produced at an economic cost.

It is a further object to provide a piston which possesses high rigidity whilst maintaining thin walled construction and hence low weight.

It is a yet further object to provide a piston which is inherently well cooled.

According to a first aspect of the present invention a method of making a piston crown comprises the steps of making a lower crown portion, the lower crown portion also having piston pin bosses, making an upper crown portion which co-operates with the lower crown portion and joining the lower and upper crown portions together to form an oil retaining chamber.

At least the lower crown portion may advantageously be made by an investment casting technique. Holes and apertures for the admission of cooling oil into and egress from the chamber formed between the upper and Lower crown portions may be finish formed complete with blending radii during the casting operation.

The lower crown portion may alternatively be a forged article.

The upper crown portion may be made by any convenient technique such as casting, stamping or forging, for example. Where the upper and lower crown portions are formed from a heat treatable ferrous alloy they may be most conveniently joined by a brazing operation during a stage of the heat treatment cycle. Any known joining technique may, however, be used including brazing, welding in any of its forms or by mechanical means, such as bolting, clenching, seaming etc.

The upper and lower crown portions may be formed from different alloy compositions so that the optimum performance may be achieved in each component. The different compositions may both be ferrous alloys or, for example, the upper crown portion may be made in a nickel or other heat-resistant alloy.

The piston crown of the present invention may be part of a piston of articulated design having a separate skirt portion or may further comprise a skirt portion integral with either the upper or the lower crown portion, for example.

Although primarily intended to solve the particular problems associated with ferrous pistons the piston crown of the present invention may be made in aluminium alloy, for example.

Furthermore, such pistons may be used in gasoline or diesel-type engines in either ferrous or aluminium alloy form.

The piston-pin boss region of the lower crown portion may be provided with oil holes to provide enhanced lubrication of the pin and pin boss region from the oil chamber.

The oil retaining chamber may be supplied with oil by any known method such as via the connecting rod or by standing jet, for example.

According to a second aspect of the present invention there is provided a piston crown when made by the method of the first aspect.

In order that the present invention may be more fully understood, an example will now be described by way of illustration only with reference to the accompanying drawings, of which:

FIG. 1(*b*) shows a similar view of a co-operating lower crown portion to the upper crown portion of FIG. 1(*a*);

Figure 3:
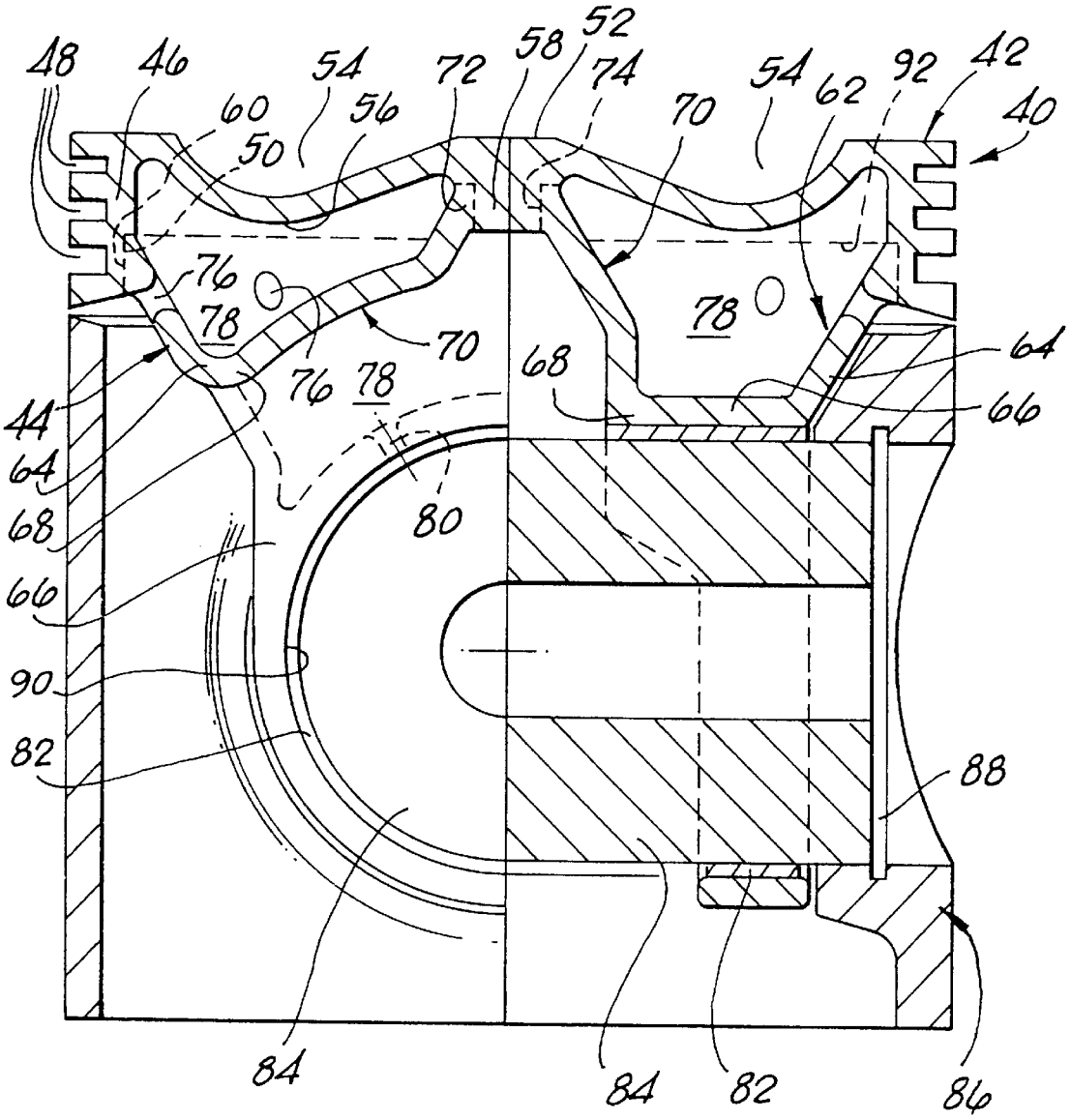
FIG. 3 shows a section in elevation of a piston according to the present invention, the left hand half of the Figure shows a section through a plane including the piston axis and normal to the piston pin axis whilst the right hand half shows a section through a plane including both the piston and the piston-pin axes.
Figure 4A:
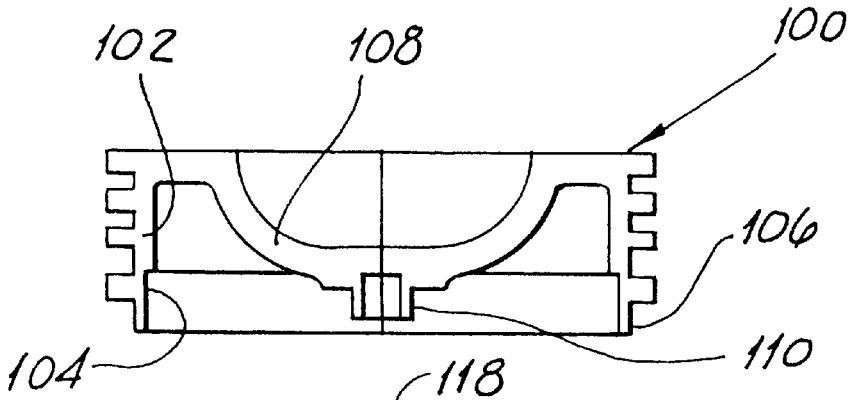
Figure 4B:
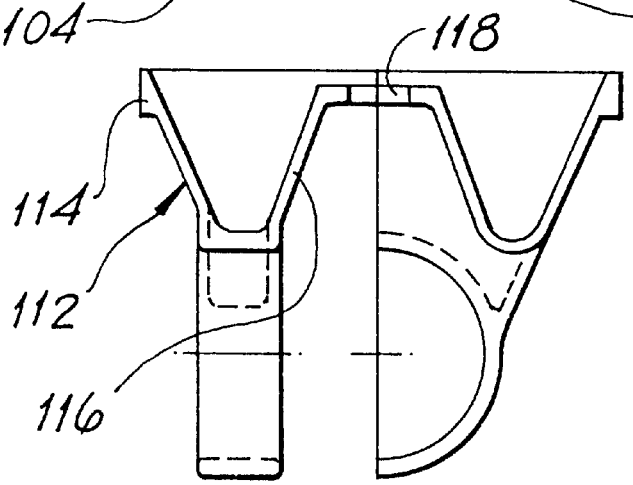
Figure 5:
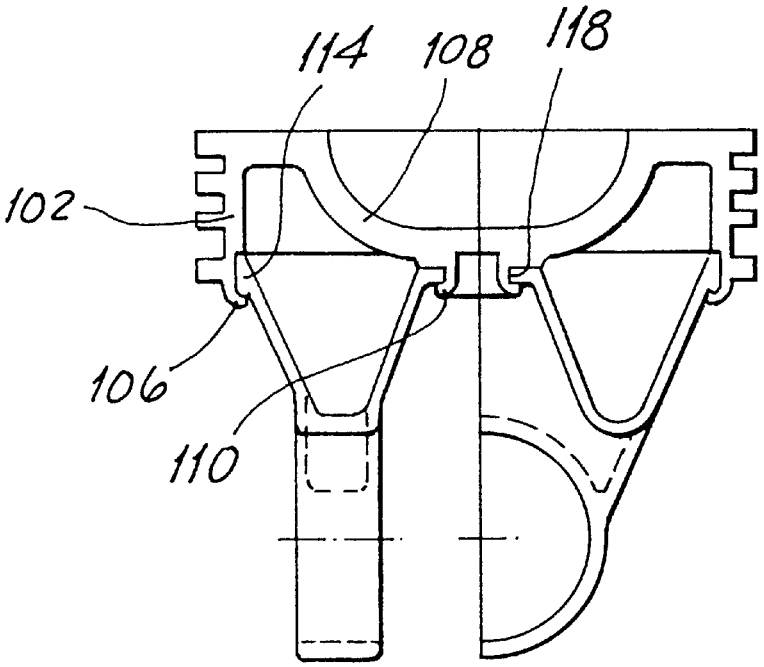
Figure 6:
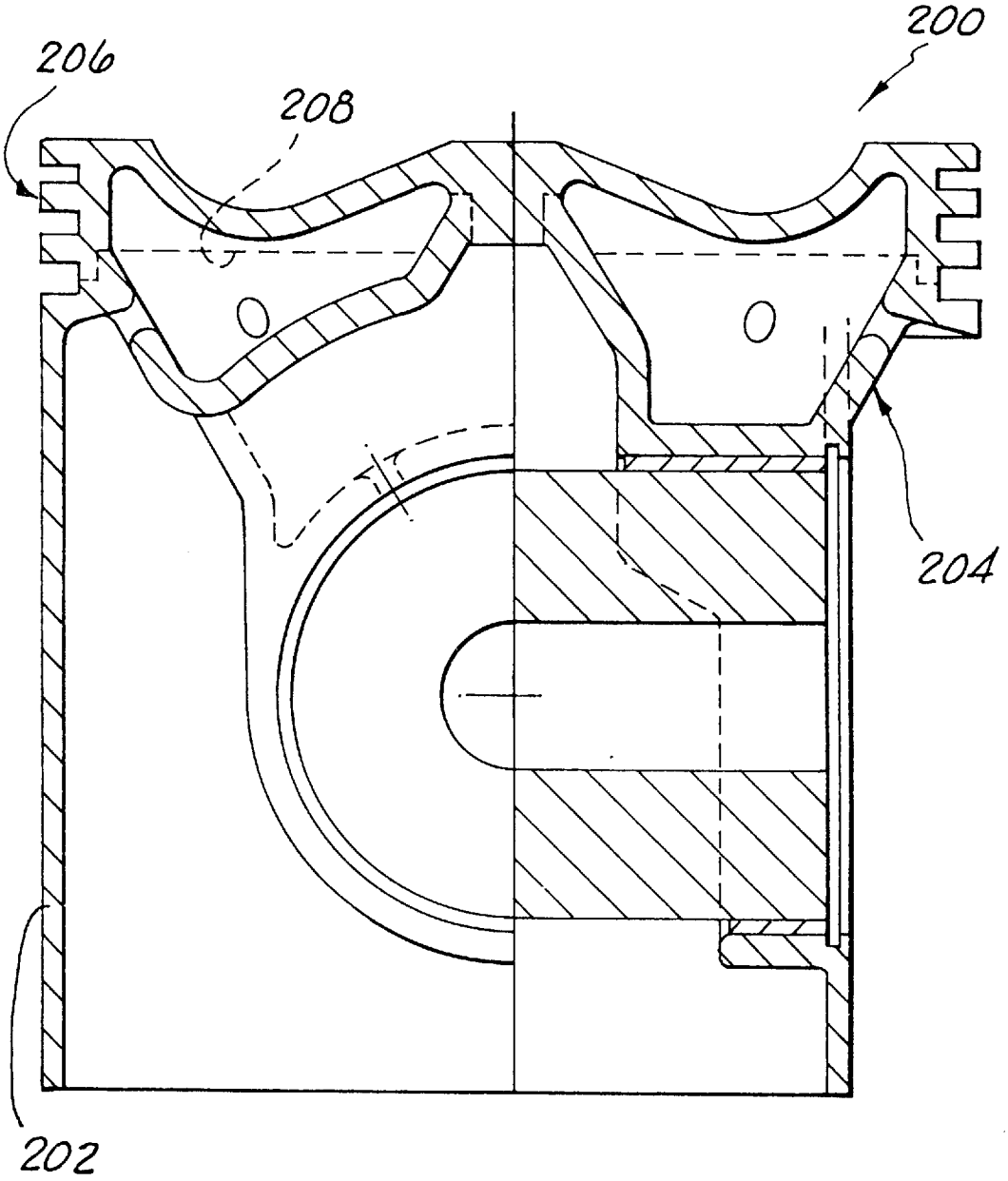

FIGS. 4(*a*) and 4(*b*) show sections in elevation of upper and lower crown portions;

FIG. 5 shows the two portions in FIGS. a) and 4(4(*b*) joined by alternative means; and FIG. 6 which shows a section similarly presented to that in FIG. 3 of a alternative piston longitudinal center according to the invention.

Figure 1A:
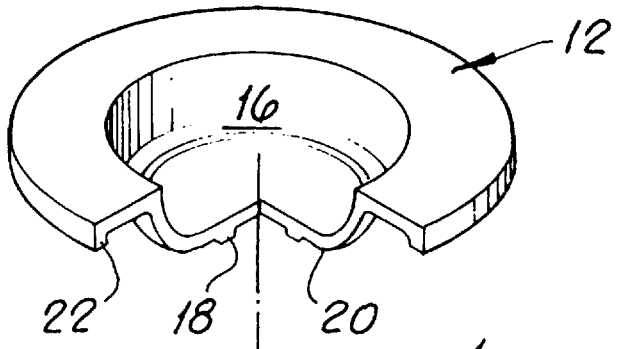
FIG. 1(*a*) shows a part-sectioned perspective view of a piston upper crown portion according to the present invention.
Figure 1B:
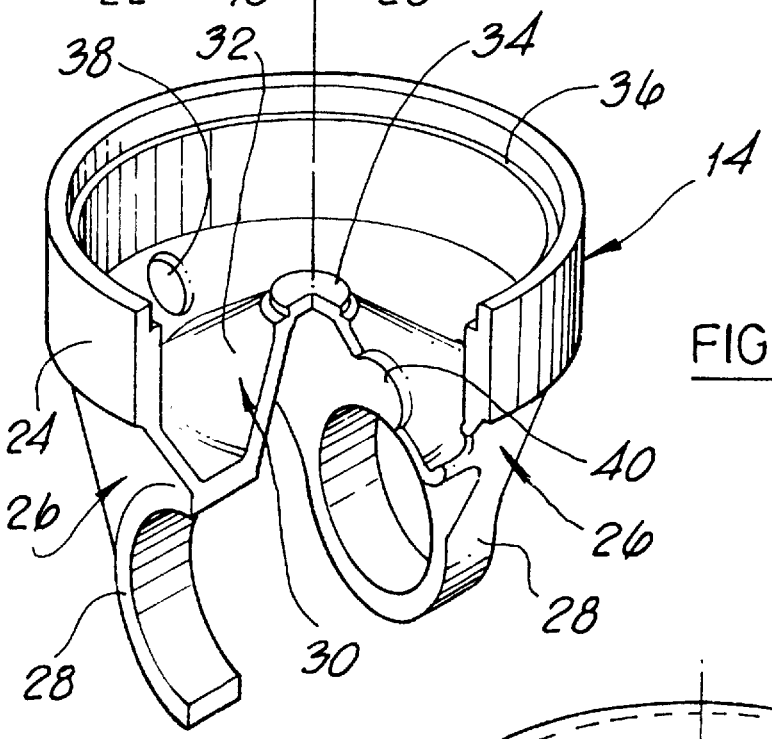
Figure 2:
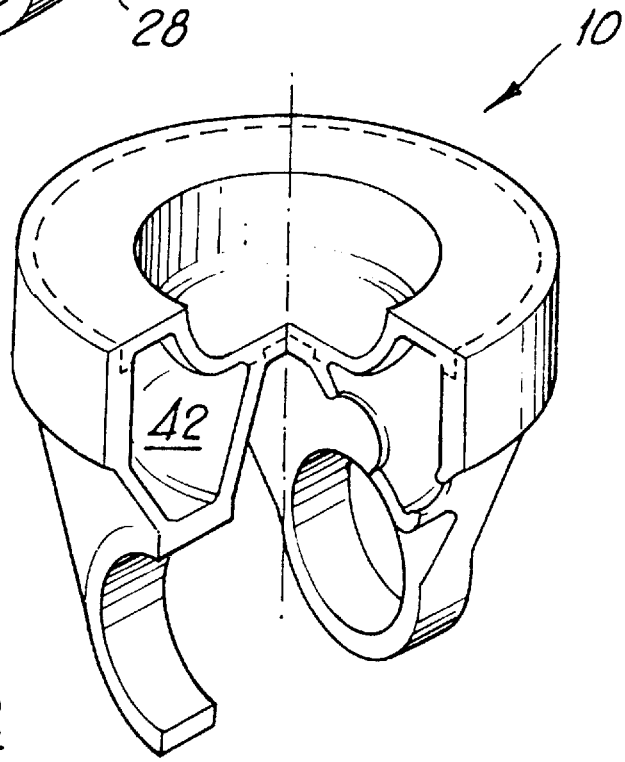
FIG. 2 shows the upper and lower portions of FIGS. 1(*a*) and 1(*b*) joined together.

Referring now to FIGS. 1(*a*), 1(*b*) and 2 and where the same features are denoted by common reference numerals.

The piston crown 10 comprises an upper crown portion 12 and a lower crown portion 14. The upper portion 12 is a precision investment casting in a stainless steel alloy and includes a centrally disposed portion defining a combustion chamber bowl 16 in finished form. Also included on the portion 12 is an annular rib 18 on the underside 20 of the combustion bowl and a downwardly turned flange 22 forming the outer periphery of the upper portion 12. Both the internal diameter of the rib 18 and the outer diamter of the flange 22 are machined to a desired dimension. The lower crown portion 14 is also a precision investment casting in a stainless steel alloy and comprises a generally cylindrical portion 24 in which piston ring grooves (not shown) may subsequently be formed. Depending from the lower end of the generally cylindrical portion 24 is a generally downwardly and inwardly directed (relative to the longitudinal center axis) web portion 26 having inner and outer surfaces which at its lower extremities blends with pin boss portions 28 and with the lower extremities of a centrally disposed web portion 30 which is generally upwardly and inwardly directed (also relative to the longitudinal center axis). At the upper end 32 of the web 30 is a spigot 34 having machined dimensions. The upper end of the generally cylindrical portion 24 has a rebated lip 36 which is machined to receive the outer periphery of the flange 22. Similarly the spigot 34 is machined to be received in the annular rib 18. Cast into the webs 26 and 30 are ports 38 and 40 to allow oil access to and egress from the chamber 42 formed when the two portions 12 and 14 are joined. The portions are joined by first smearing the mating surfaces with brazing paste and vacuum furnace brazing during the solution heat treatment cycle for the stainless steel.

Referring now to FIG. 3 and where the piston crown 40 comprises an upper portion 42 and a Lower portion 44. The upper portion in this embodiment includes a generally cylindrical portion 46 having piston ring grooves 48. At the lower end of the cylindrical portion 46 there is an inwardly facing rebate 50. The top face 52 comprises a combustion bowl 54 whilst the underside 56 has a centrally disposed spigot 58. The Lower crown portion 44 has an upwardly and outwardly facing circular peripheral rim 60 machined to co-operate with the rebate 50. Extending downwardly and inwardly from the periphery 60 is a web 62 which at its Lower extremities 64 blends into pin-bosses 66 and into the lower end extremities 68 of an upwardly and inwardly directed web 70 which terminates its upper end 72 with a machined hole 74 to co-operate with the spigot 58 of the upper crown portion 42. Formed in the portion 44 are holes 76 which serve to allow oil access to the chamber 78 and also to act as level control weirs. Holes 80 are formed though the pin bosses 66 to provide Lubrication to pin-boss bushes 82 and the piston pin 84 from the oil reservoir in the chamber 78. An articulated skirt portion 86 is attached to the piston crown 40 via the pin 84 and located by circlips 88. As before the upper and lower crown portions are joined by vacuum furnace brazing of the mating surfaces. The joint between the two portions is indicated by the broken line 92. The bushes 82 may also be permanently located in the pin-boss bores 90 by brazing during, for example, a precipitation treatment subsequent to the solution treatment operation in which the upper and lower portions were joined.

FIGS. 4(*a*), 4(*b*) and 5 show an alternative method of pining the upper and lower crown portions together. The upper portion 100 has a generally cylindrical portion 102 having at the lower end thereof a rebated portion 104 with a thinned, extended lip 106. Depending from the underside of a bowl 108 is a tubular spigot 110. The lower crown portion 112 has a circular flanged lip 114 which co-operates with the rebated portion 104. The inner web 116 has at its upper extremity a hole 118 which co-operates with the tubular spigot 110. The upper and lower portions are joined together by swaging of the thinned lip 106 around the circular flanged lip 114 and of the face end of the spigot 110 around the underside of the hole 118 as shown in FIG. 5.

The construction shown in FIG. 6 shows a piston 200 having an integral skirt 202. The skirt is cast integrally with the lower crown portion 204. The joint line between the upper crown portion 206 and the lower portion is denoted by the broken line 208 and the lower portion is denoted by the broken line 208. Construction is otherwise similar to that shown in FIG. 3.

The constructions described produce very light and rigid piston crowns. The precision castings employed are very simple and easily produced by known techniques.

In the same instance where the upper crown portion is of relatively simple form it may alternatively be produced as a stamping or machining, for example.

Because of the efficient cooling of the combustion bowl the construction allows very low compression height to be achieved thus enabling the overall height and weight of the engine to be reduced.

Ring grooves may be placed near to the crown face because of the improved cooling. Minimising the dead space above the top ring is beneficial in terms of reduced emissions.

I claim:

1. A piston crown having a longitudinal center axis, said crown comprising an upper crown portion having a first substantially circular upper peripheral edge, a discrete lower crown portion having a second substantially circular lower peripheral edge and a first web portion having inner and outer surfaces, said first web portion including said inner and outer surfaces extending from said second lower peripheral edge in a downwardly and inwardly direction relative to said longitudinal center axis and meets at is radial inner extent with a second, generally centrally disposed web portion which extends from said inner extent in an upwardly and inwardly direction relative to said longitudinal center axis and which at its uppermost extremity engages and supports a centrally disposed portion of said upper crown portion; a generally cylindrical portion having at least one piston ring groove in the outer surface thereof and which cylindrical portion is disposed between the outer periphery of said upper crown portion and the outer periphery of said lower crown portion to form a chamber between said upper and lower crown portions and said cylindrical portion.

2. The piston crown according to claim 1 wherein said centrally disposed portion of said upper crown portion also includes a combustion chamber bowl.

3. The piston crown according to claim 2 wherein the uppermost extremity of said second web supports an underside of said combustion chamber bowl.

4. The piston crown according to claim 1 wherein said lower crown portion further includes pin boss portions.

5. A piston crown according to claim 4 and having lubrication holes from said chamber to bores in at least one of said pin boss portions.

6. The piston crown according to claim 1 wherein said first web portion includes at least one aperture for the passage of oil.

7. The piston crown according to claim 1 wherein said second web portion includes at least one aperture for the passage of oil.

8. The piston crown according to claim 1 and having an integral skirt portion attached thereto.

* * * * *